US011359408B2

(12) United States Patent
Kim et al.

(10) Patent No.: US 11,359,408 B2
(45) Date of Patent: Jun. 14, 2022

(54) INDICATOR-TYPE DOOR LOCK

(71) Applicant: ASSA ABLOY KOREA, Seoul (KR)

(72) Inventors: Jeong Sik Kim, Daegu (KR); Yong Hyun Kim, Daegu (KR)

(73) Assignee: ASSA ABLOY Korea

( * ) Notice: Subject to any disclaimer, the term of this patent is extended or adjusted under 35 U.S.C. 154(b) by 93 days.

(21) Appl. No.: 16/888,417

(22) Filed: May 29, 2020

(65) Prior Publication Data

US 2021/0148136 A1 May 20, 2021

(51) Int. Cl.

| | |
|---|---|
| ***E05B 41/00*** | (2006.01) |
| ***E05B 1/00*** | (2006.01) |
| ***E05B 39/00*** | (2006.01) |
| ***E05B 17/22*** | (2006.01) |

(52) U.S. Cl.

CPC ..... *E05B 41/00* (2013.01); *E05B 1/003* (2013.01); *E05B 17/226* (2013.01); *E05B 39/00* (2013.01)

(58) Field of Classification Search

CPC ..... E05B 1/003; E05B 17/22; E05B 17/226; E05B 39/00; E05B 41/00

See application file for complete search history.

(56) References Cited

U.S. PATENT DOCUMENTS

| | | | | |
|---|---|---|---|---|
| 2,315,102 | A * | 3/1943 | Adams | E05B 41/00 70/432 |
| 2,455,208 | A * | 11/1948 | Wirth | E05B 41/00 70/423 |
| 3,368,375 | A * | 2/1968 | Russell | E05B 41/00 70/149 |
| 4,559,796 | A * | 12/1985 | De Forrest, Sr. | E05B 41/00 70/432 |
| 9,169,669 | B2 * | 10/2015 | Clary | E05B 41/00 |
| 9,845,620 | B2 * | 12/2017 | Bronner | E05B 63/0017 |
| 9,879,445 | B2 | 1/2018 | Gopalakrishnan et al. | |
| 10,563,425 | B2 * | 2/2020 | Lunday | E05B 41/00 |
| 2011/0016938 | A1 * | 1/2011 | Chi | E05B 41/00 70/432 |
| 2019/0323264 | A1 | 10/2019 | Lunday | |
| 2020/0190856 | A1 * | 6/2020 | Kaverina | E05B 41/00 |

FOREIGN PATENT DOCUMENTS

KR 101458754 B1 11/2014

OTHER PUBLICATIONS

Mar. 24, 2020 Office Action issued in Korean Patent Application No. 10-2020-0010025.

* cited by examiner

*Primary Examiner* — Christopher J Boswell
(74) *Attorney, Agent, or Firm* — Wolf, Greenfield & Sacks, P.C.

(57) ABSTRACT

An indicator-type door lock that may prevent the door lock device from being enlarged while user may intuitively identify the lock state of the door lock at the outside. An indicator-type door lock including: a handle shaft having a handle for unlocking and a push button for locking; a driving body mounted with the handle shaft; a door lock main body having a main body cover with at least one display portion displaying the locked state of the door lock to the outside, and installed in front of the driving body; an indicator member installed within the door lock main body to be pivoted to a certain radius, and being exposed through the display portion; and a turning drive member for pivoting the indicator member located within the handle shaft and rotated inside the handle shaft when the push button is pressed to pivot indicator member.

6 Claims, 16 Drawing Sheets

【Fig. 1】
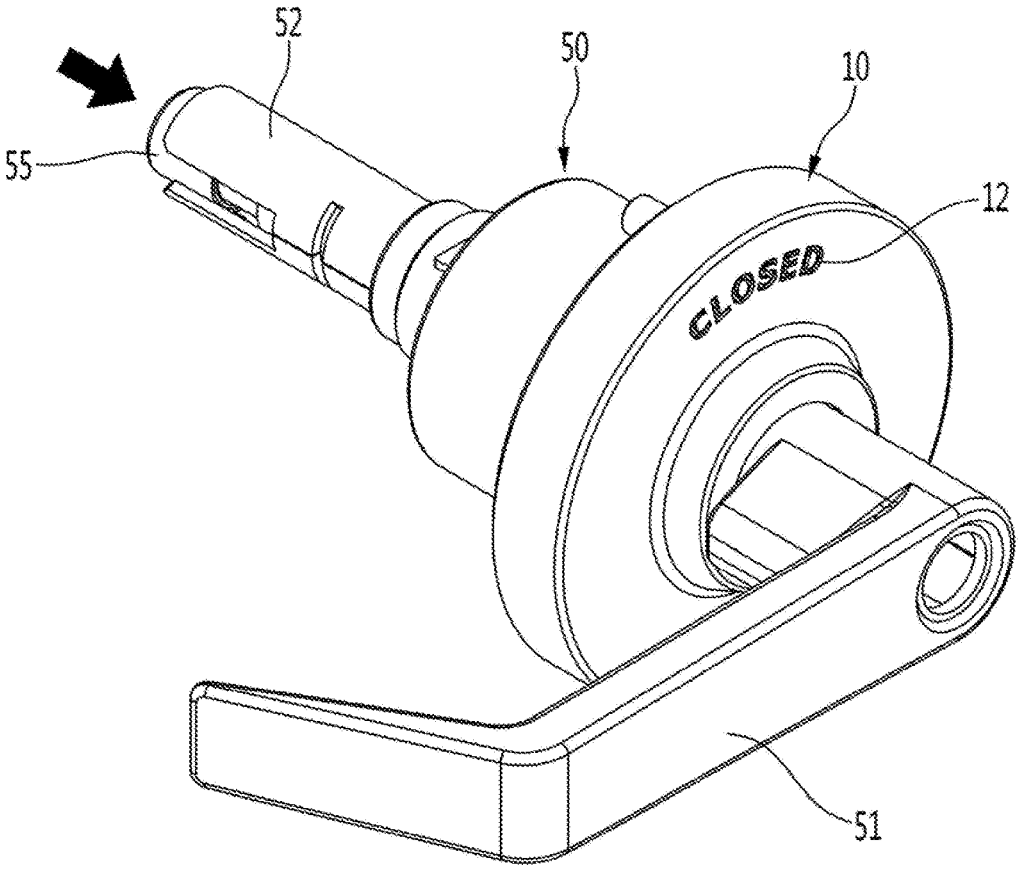

【Fig. 2】
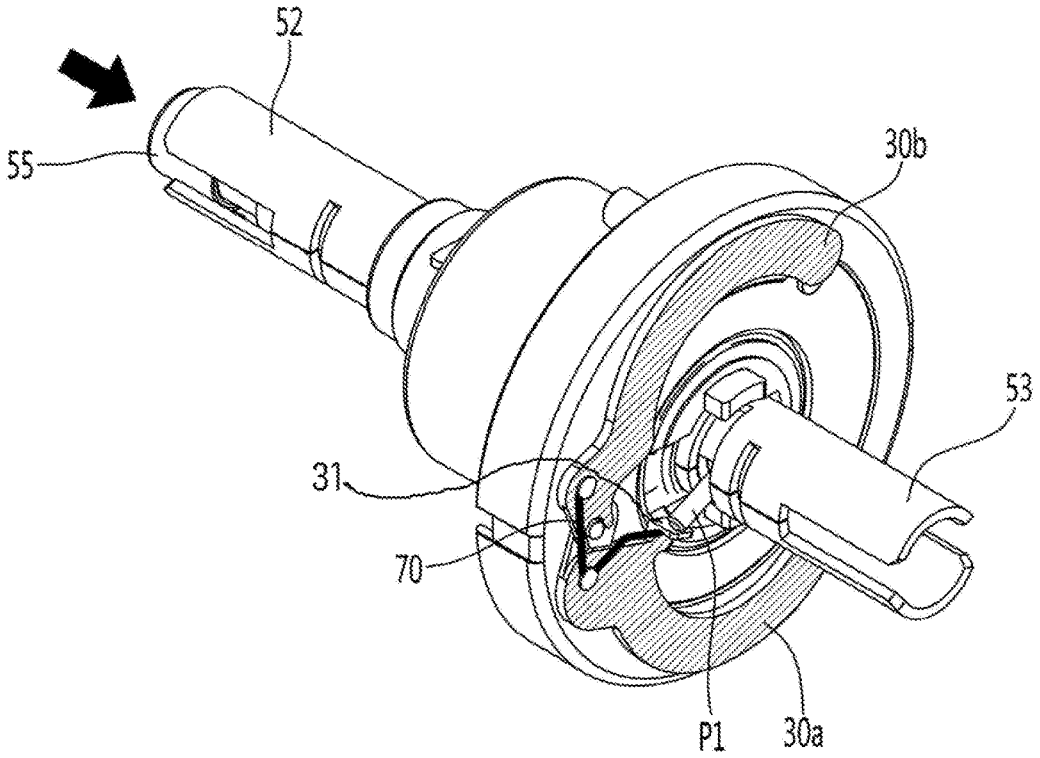

【Fig. 3】
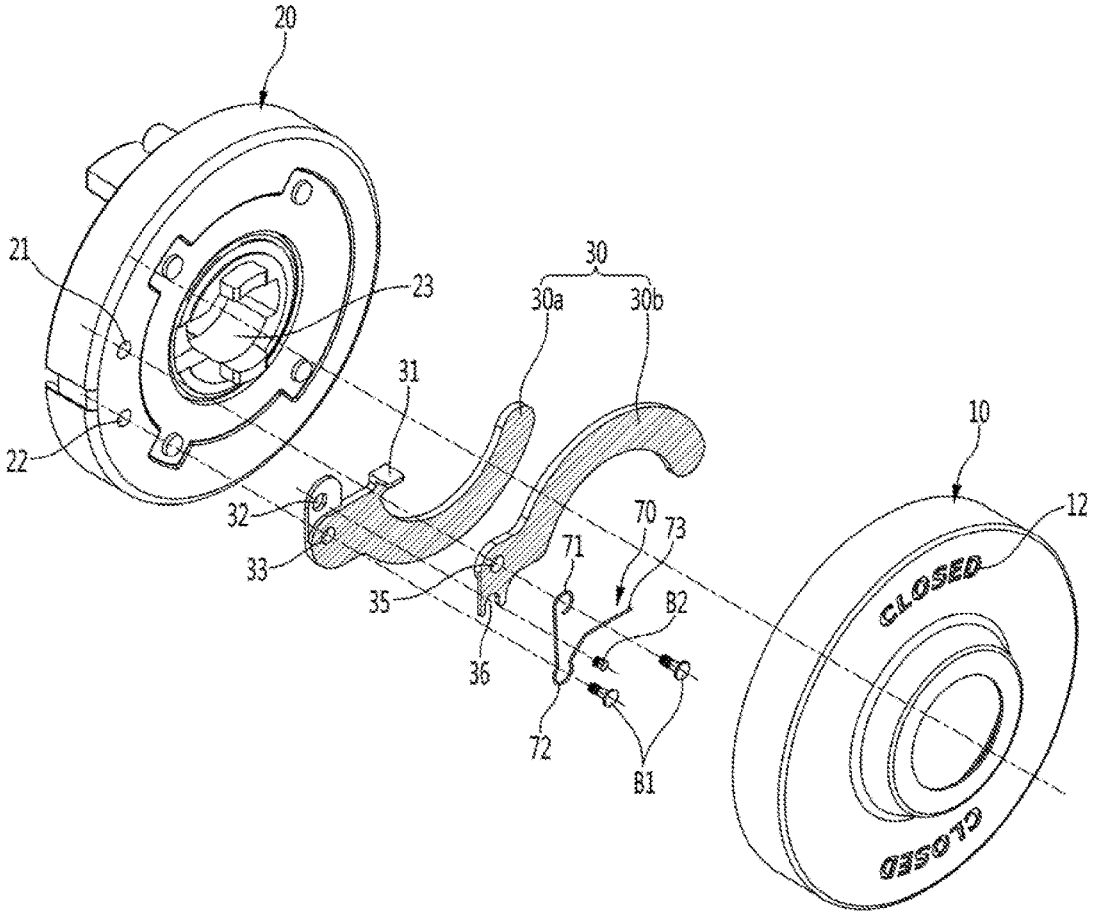

【Fig. 4】
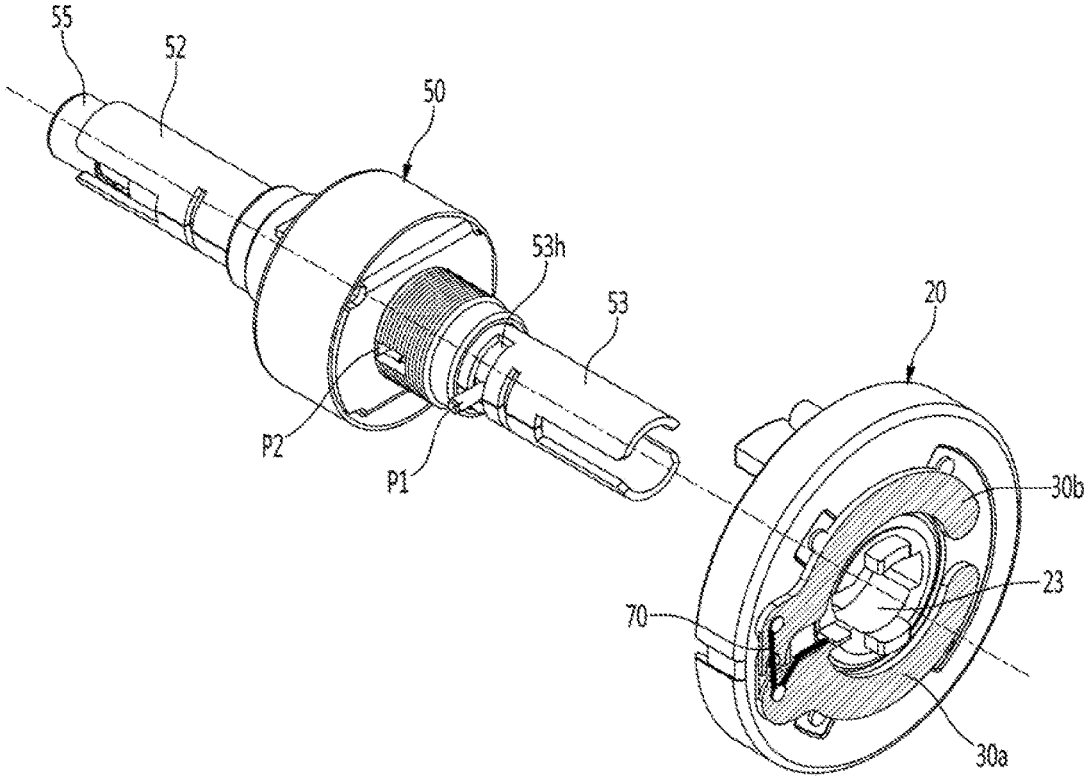

【Fig. 5A】
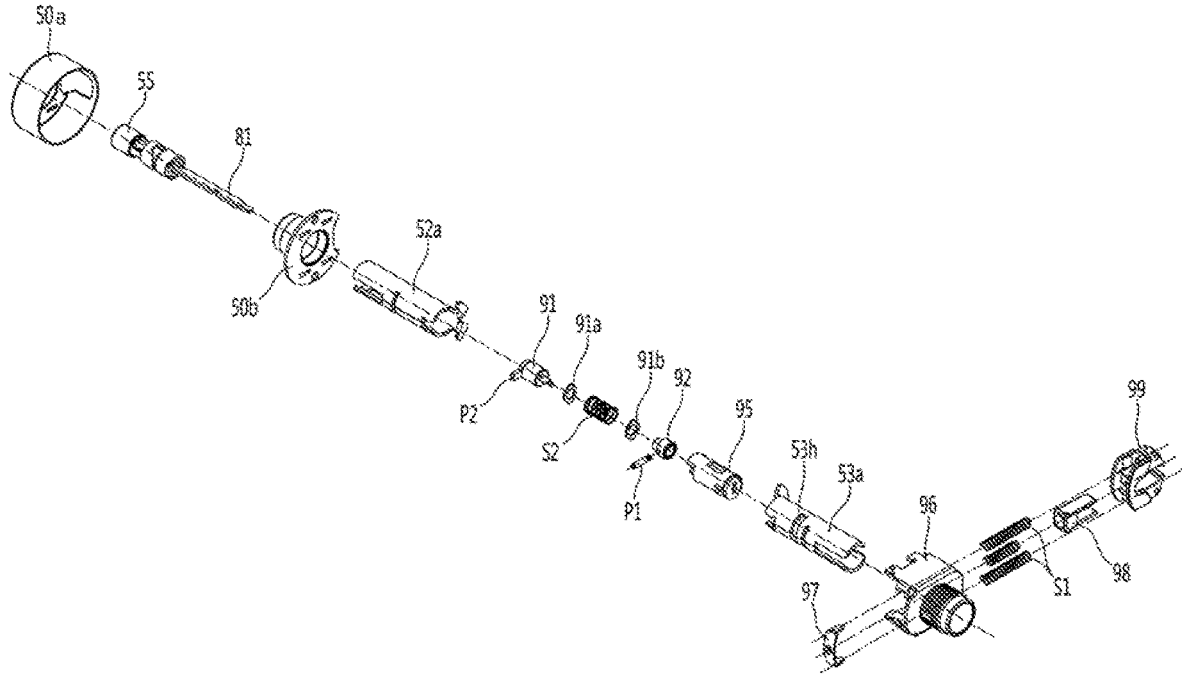
【Fig. 5B】
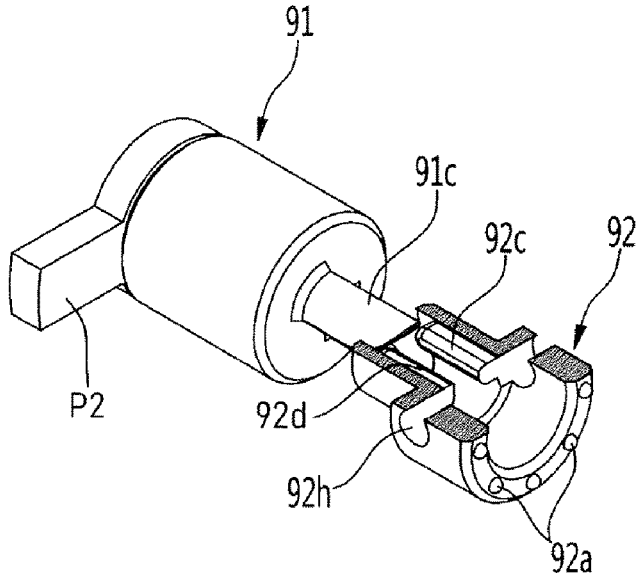

【Fig. 5C】
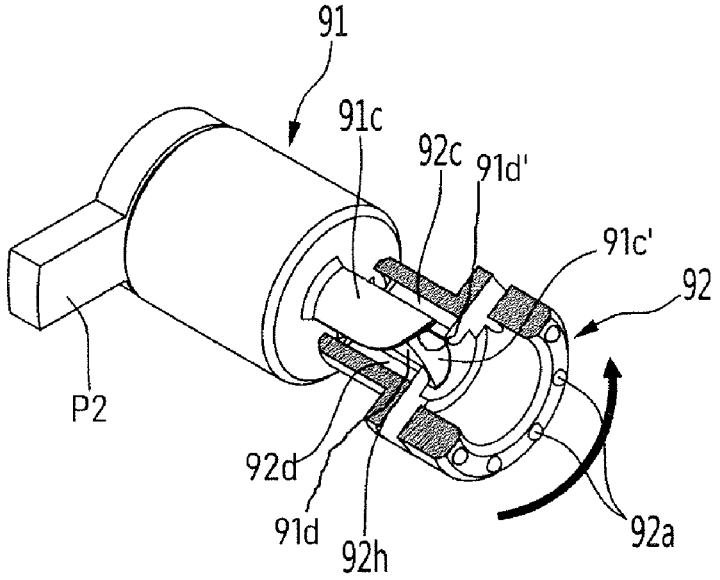
【Fig. 6】
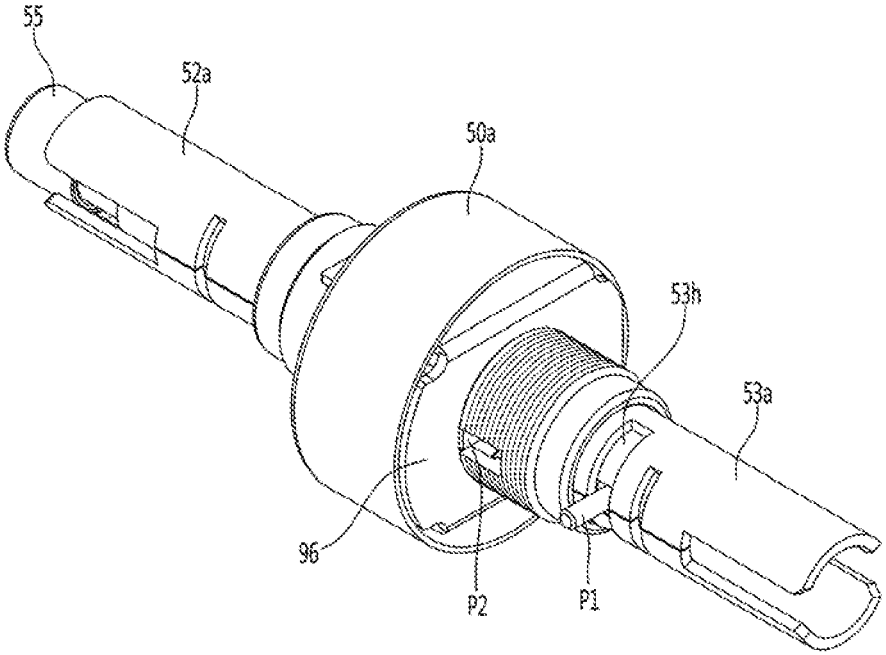

【Fig. 7】
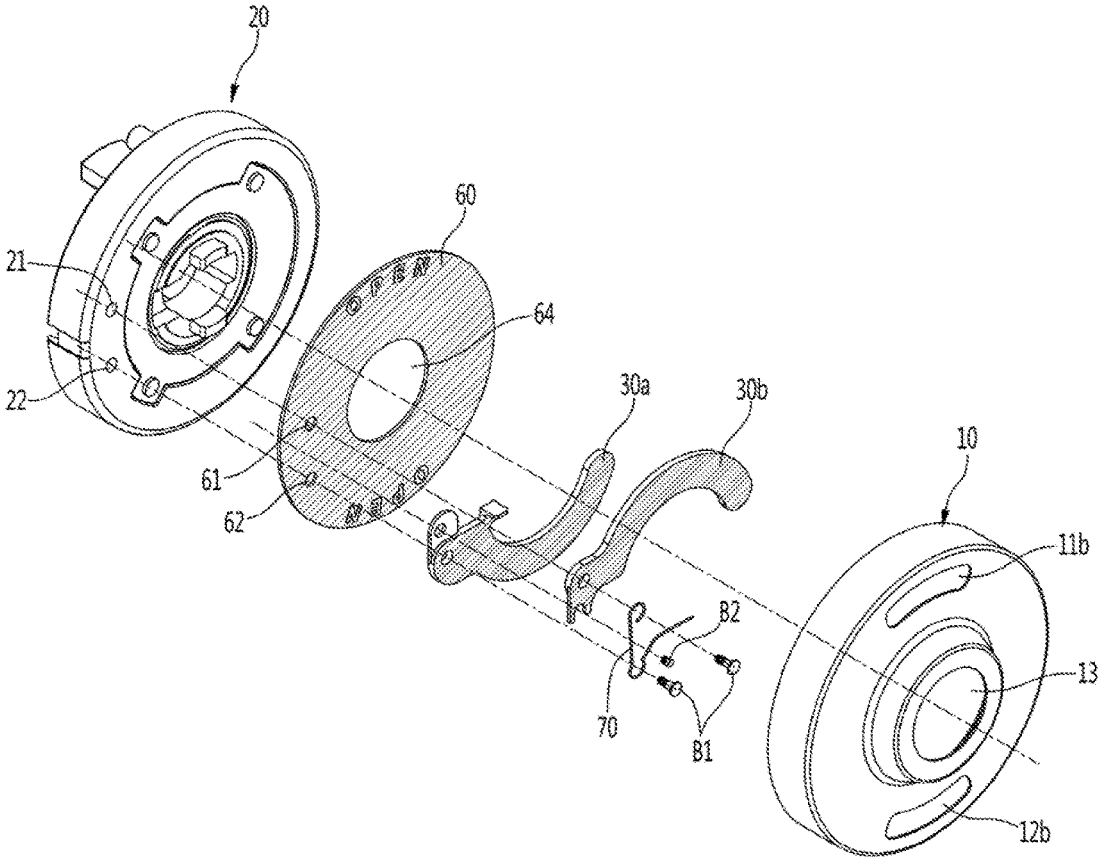

【Fig. 8A】
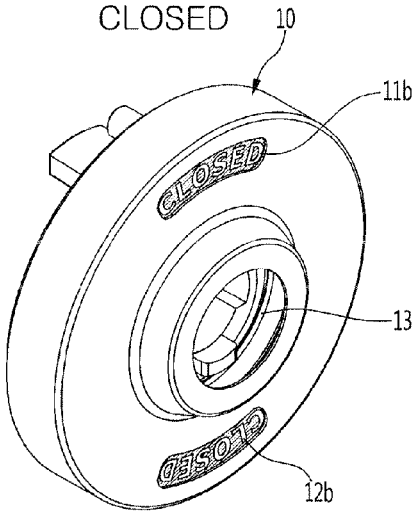
【Fig. 8B】
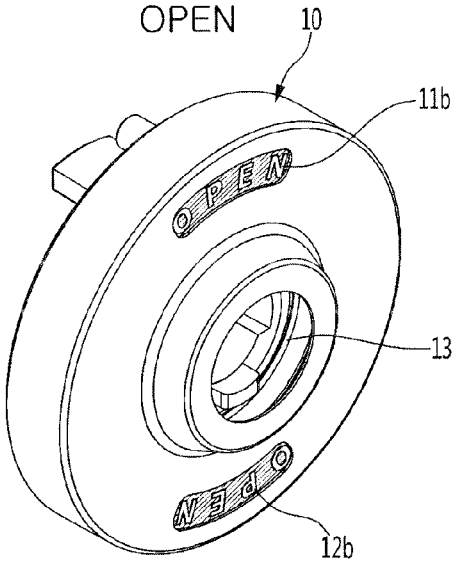

【Fig. 9A】
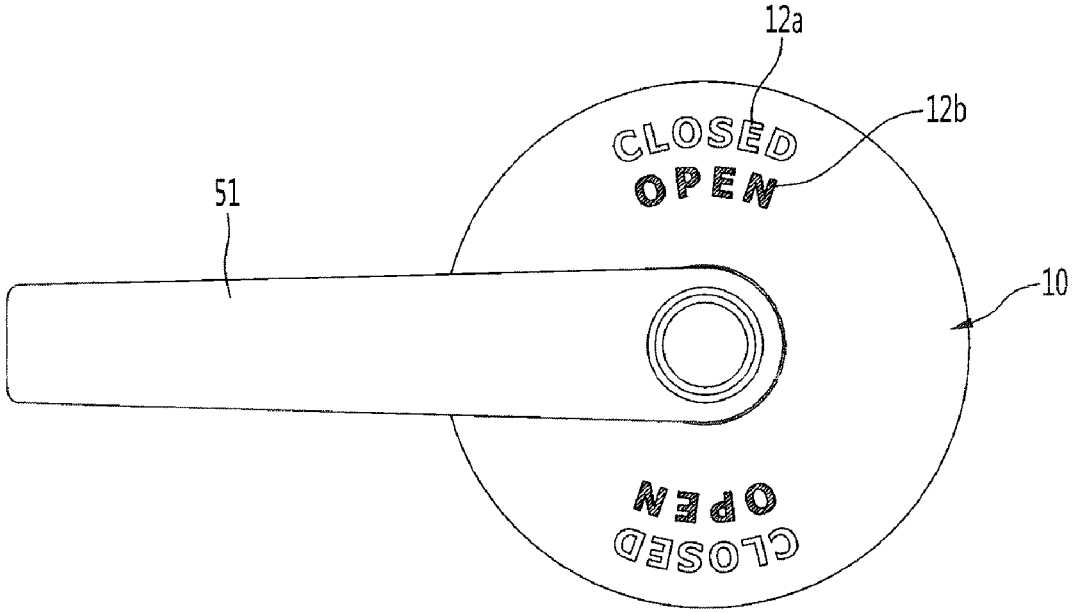
【Fig. 9B】
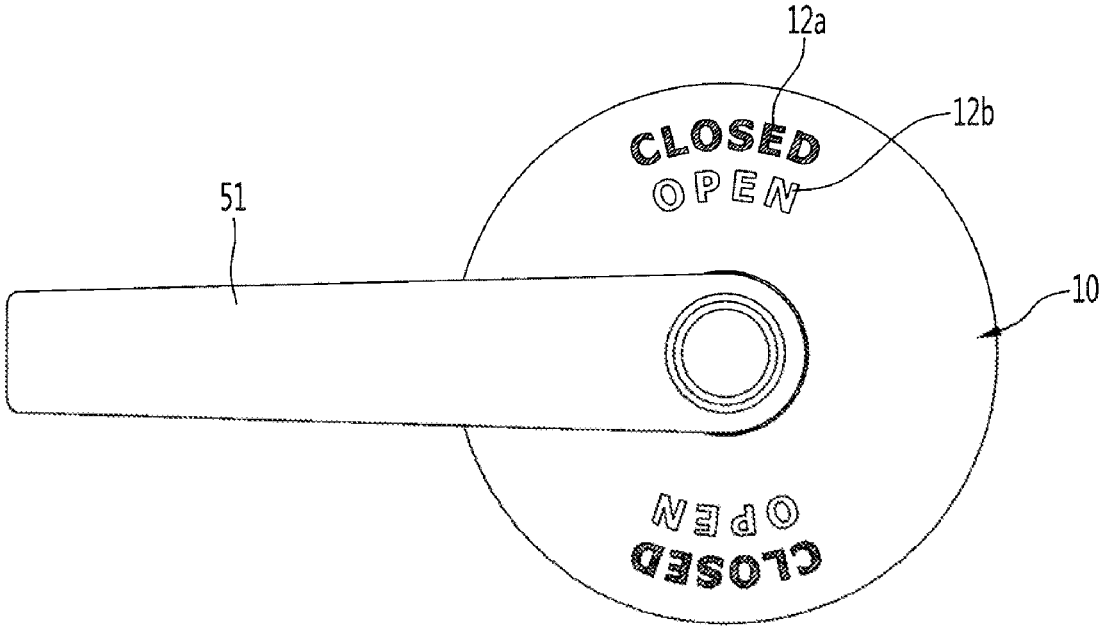

【Fig. 10A】
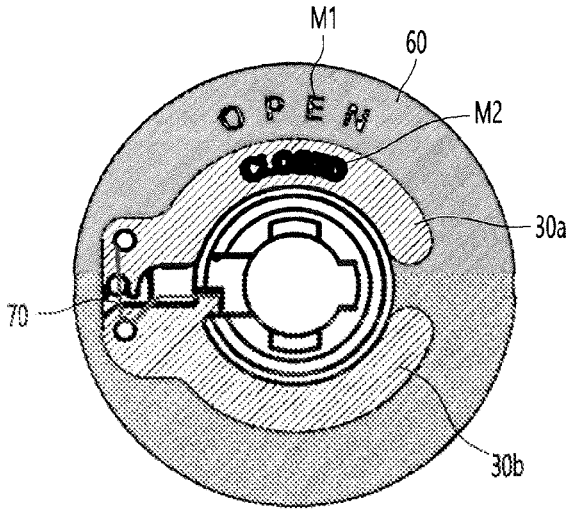
【Fig. 10B】
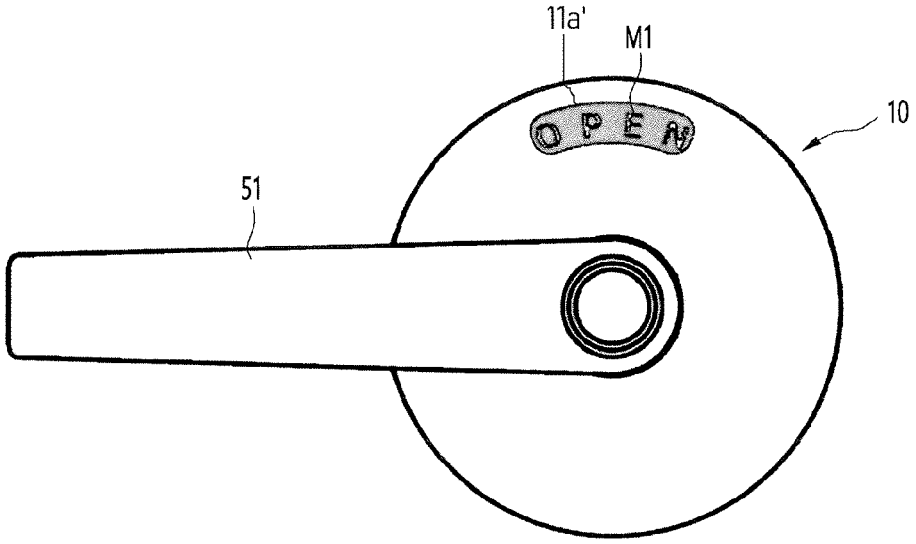

【Fig. 11A】
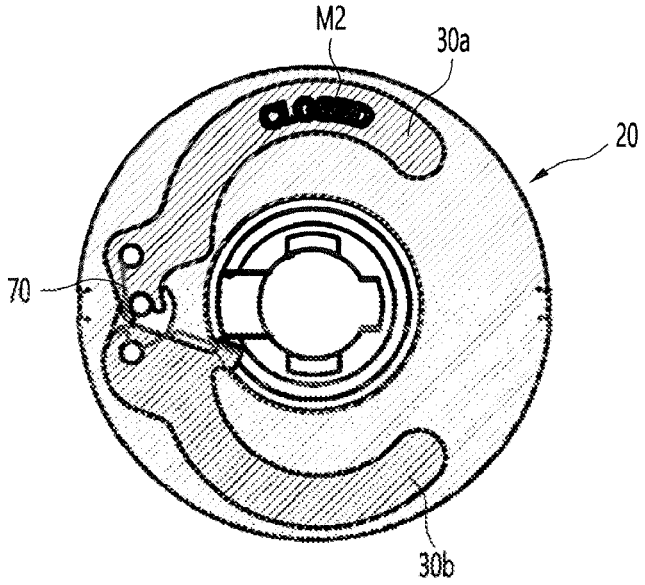
【Fig. 11B】
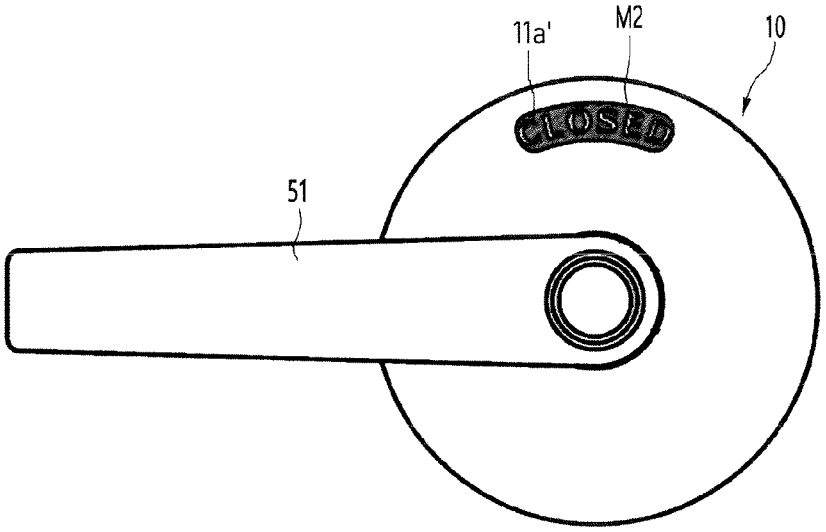

【Fig. 12A】
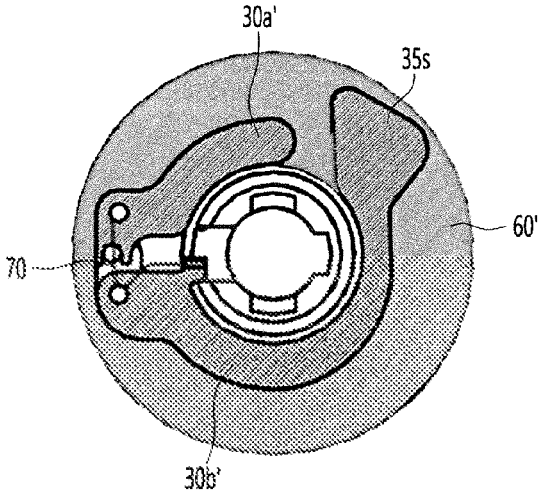
【Fig. 12B】
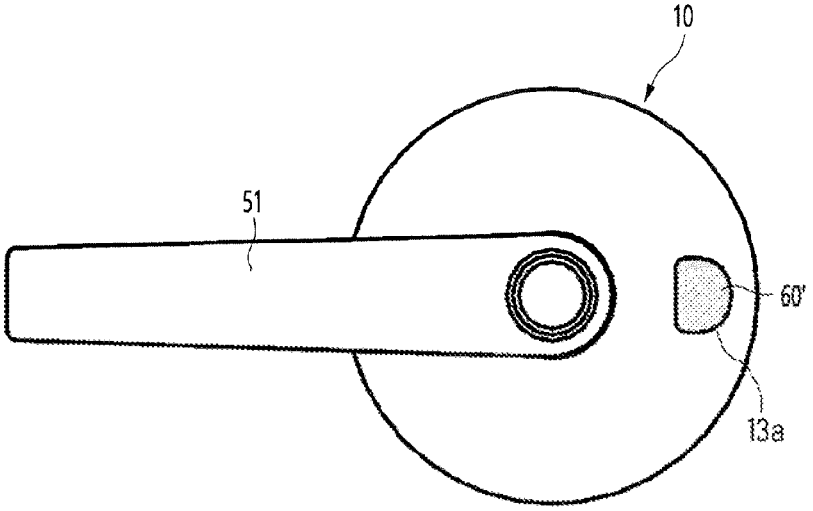

【Fig. 13A】
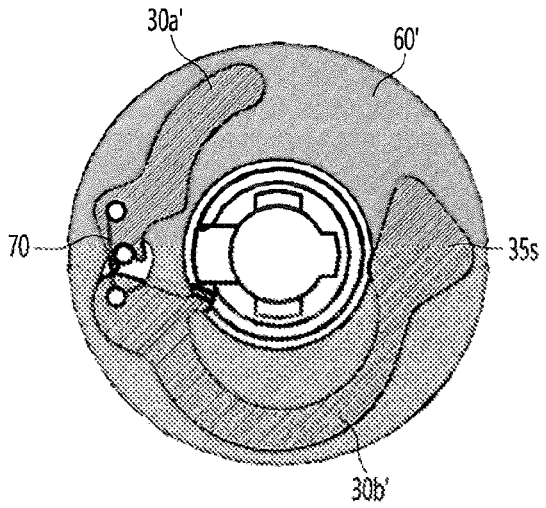
【Fig. 13B】
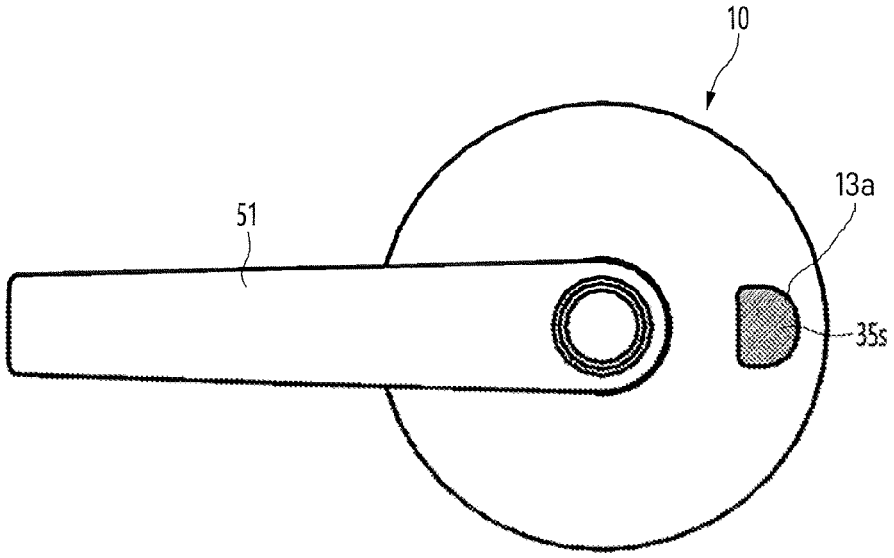

【Fig. 14】
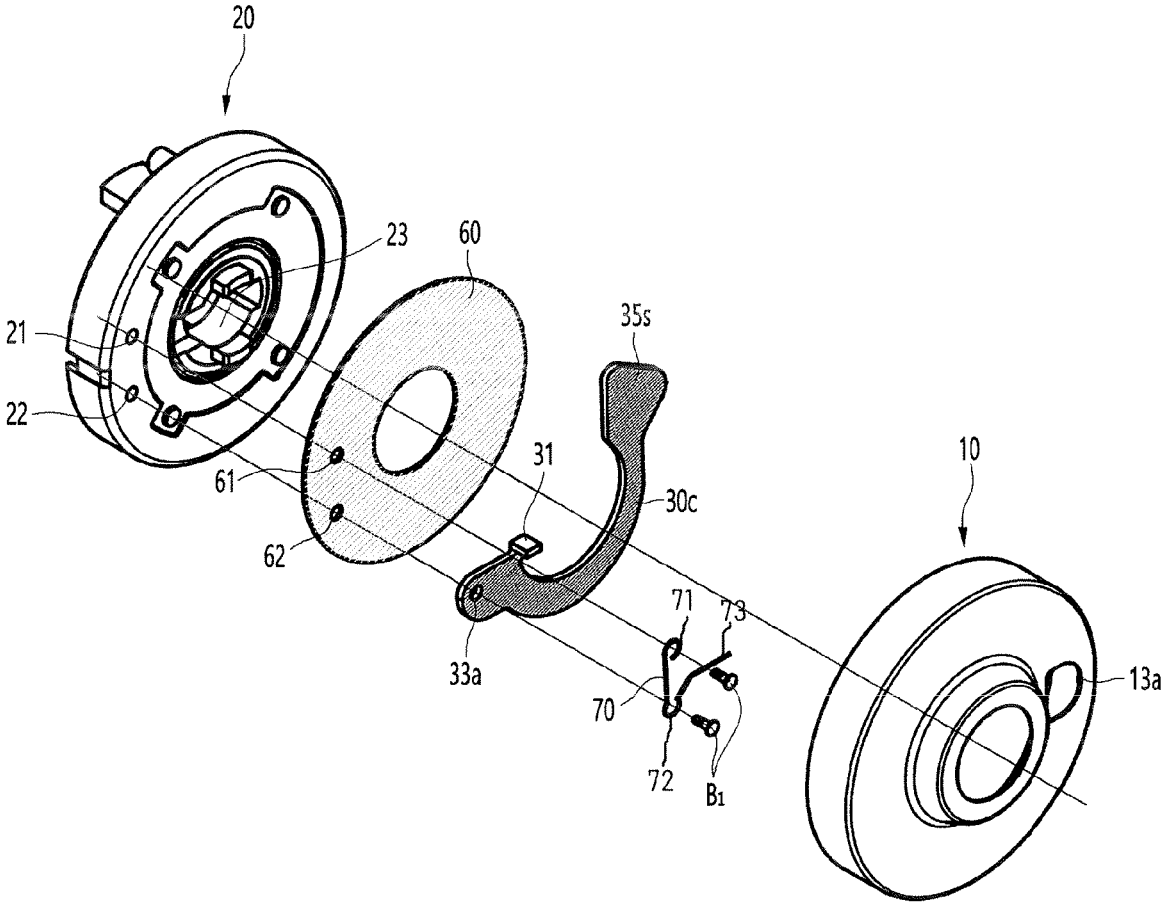

【Fig. 15A】
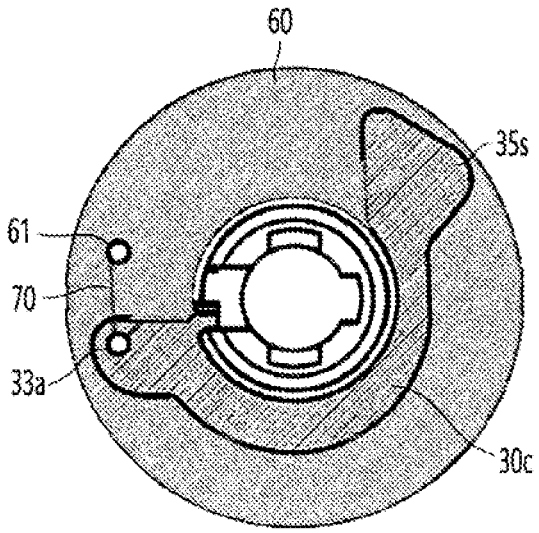
【Fig. 15B】
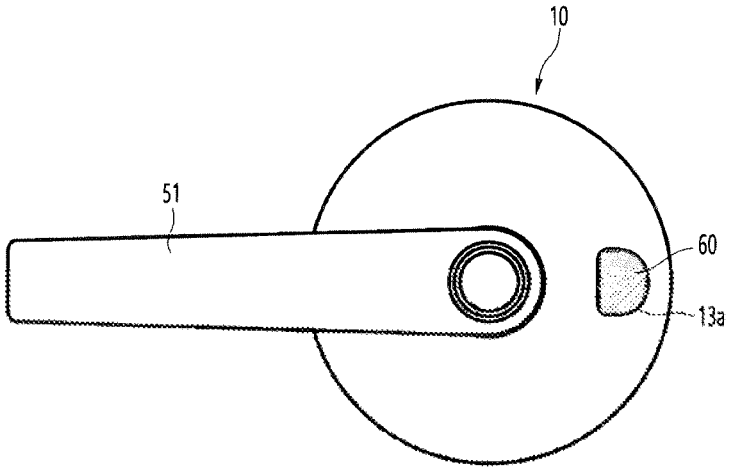

【Fig. 16A】
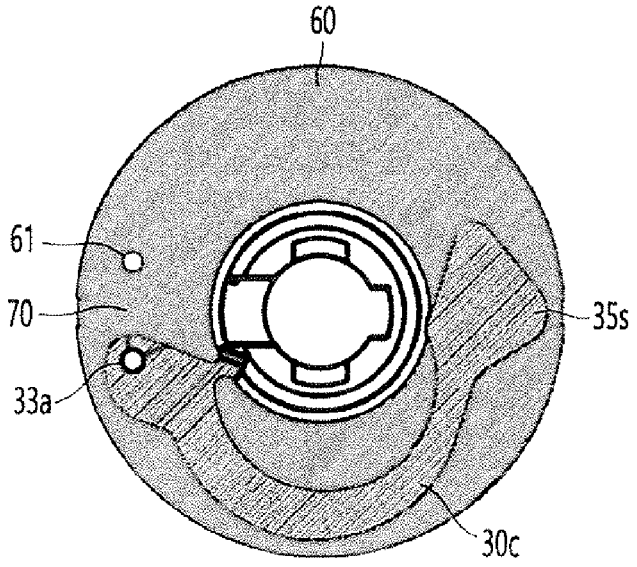
【Fig. 16B】
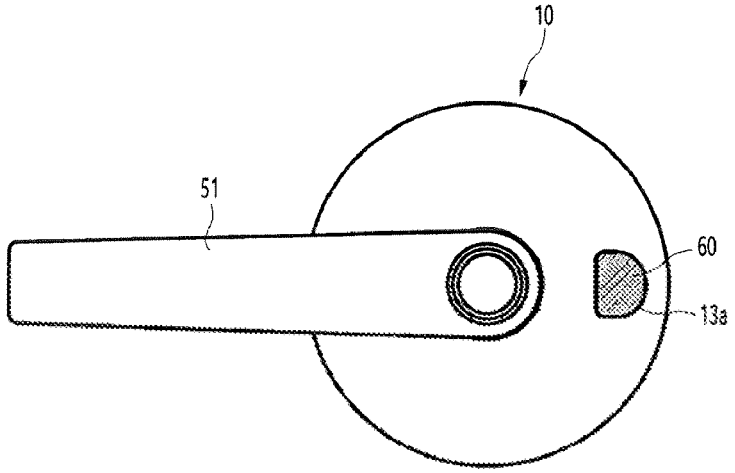

INDICATOR-TYPE DOOR LOCK

FIELD OF THE INVENTION

The present invention relates to a door lock, and more particularly, to an indicator-type door lock that may display the lock state of the door lock toward the outside.

DESCRIPTION OF THE PRIOR ART

Generally, a door lock device is installed in a building as a device for locking a door to restrict outsiders from entering the building.

The door lock device is embedded in a door or installed to be exposed to the outside of a door. In addition, a conventional door lock includes parts connected to indoor/outdoor handles for locking and unlocking the door. For example, the parts may be a mortis.

On the other hand, the door lock includes not only mortis but also a digital part installed at an outdoor side of a door to operate the mortis and a key operation part for releasing a locked state of a door.

As one example of a conventional door lock, a lever-type door lock is disclosed, wherein this lever-type door lock is installed to control access to an indoor space (for example, a room or a bathroom).

The lever-type door lock rotates either an indoor lever (handle) or an outdoor lever (handle) to activate a latch actuator of the door lock, so that a latch bolt may be pulled in or out from a strike installed on a door frame. Consequently, it is possible to lock or unlock the door lock.

Recently, the existing door locks have been continuously improved with the development of technology. In particular, the technology for preventing the unauthorized opening of a door by an intruder is the most important factor in the door lock device, and the technology to improve user convenience is also an important factor.

In particular, along with the security capability of the door lock device, a demand for miniaturization of the device and convenience in use is increasing.

<Prior Art 1> Korean Utility Model Publication No. 2018-0003019 (Published on: Oct. 19, 2018)

SUMMARY OF THE INVENTION

It is the object of the present invention to provide an indicator-type door lock that allows a user to intuitively check a lock state of the door lock at the outside, and also to downsize the door lock device.

To achieve the object, according to an aspect of the present invention, there is provided an indicator-type door lock wherein the indicator-type door lock comprising: a handle shaft having a handle for unlocking and a push button for locking; a driving body mounted with the handle shaft; a door lock main body having a main body cover with at least one display portion displaying the locked state of the door lock to the outside, and installed in front of the driving body; an indicator member installed within the door lock main body to be pivoted to a certain radius, and being exposed through the display portion; and a turning drive member for pivoting the indicator member located within the handle shaft and rotated inside the handle shaft when the push button is pressed.

The indicator member may include a first display member pivotably mounted on the door lock main body, and a second display member pivotably mounted on the door lock main body and is pivoted in a direction opposite to the first display member about a pivot point in conjunction with the first display member.

The turning drive member may include a cam portion moving in a straight direction in the handle shaft by the push button and having at least one cam post formed on its front surface; and a pin rotator having at least one guide rib guided along the cam post of the cam portion on an inner circumferential surface thereof and a driving pin mounted on an outer circumferential surface thereof to pivot the indicator member to one side.

The display portion is provided in a shape in which a portion of the main body cover is penetrated, the indicator member is exposed to the outside through the penetrated area of the display portion.

The door lock main body has a display plate marked with at least one display letter, and the indicator member is pivotally mounted in front of the display plate.

A pin spring may be installed in the pivot point of the first display member and the second display member to apply an elastic force between the first display member and the second display member.

Any one of the first display member and the second display member may further include an indicator region integrally extending from an end of the first display member or the second display member.

The indicator member may include a single display member pivotably mounted on the door lock main body, and a pin spring fixed to the door lock main body to elastically support the single display member.

According to the present invention, when a push button is pressed on a flat indicator member installed inside the door lock main body, the indicator member is exposed to the outside through a display portion so that a lock state of the door lock may be easily recognized by a user, thus increasing convenience in use. In addition, the device may be miniaturized by using a structure that drives the indicator member to convert a push force of the push button to a rotational force by using a handle shaft.

BRIEF DESCRIPTION OF THE DRAWINGS

FIG. 1 is a perspective view of an indicator-type door lock according to a first embodiment of the present invention.

FIG. 2 is a perspective view showing an installation state of an indicator member of the indicator-type door lock according to the first embodiment of the present invention.

FIG. 3 is a perspective view showing a disassembled state of the indicator member of the indicator-type door lock according to the first embodiment of the present invention.

FIG. 4 is an exploded view of a driving body and a door lock main body of the indicator-type door lock according to the first embodiment of the present invention.

FIG. 5A is an exploded view of the driving body of the indicator-type door lock according to the first embodiment of the present invention.

FIG. 5B and FIG. 5C are drawings showing a connection state of a cam portion and a pin rotator of the indicator-type door lock according to the first embodiment of the present invention.

FIG. 6 is a perspective view of the driving body of the indicator-type door lock according to the first embodiment of the present invention;

FIG. 7 is an exploded view of the indicator-type door lock according to a second embodiment of the present invention.

FIG. 8A and FIG. 8B are drawings showing the use of the indicator-type door lock according to the second embodiment of the present invention.

FIG. 9A and FIG. 9B are drawings showing the use of the indicator-type door lock according to a third embodiment of the present invention.

FIG. 10A to FIG. 11B are drawings showing the use of the indicator-type door lock according to a fourth embodiment of the present invention.

FIG. 12A to FIG. 13B are drawings showing the use of the indicator-type door lock according to a fifth embodiment of the present invention.

FIG. 14 is an exploded view of the indicator-type door lock according to a sixth embodiment of the present invention.

FIG. 15A to FIG. 16B are drawings showing the use of the indicator-type door lock according to the sixth embodiment of the present invention.

DETAILED DESCRIPTION OF THE EXEMPLARY EMBODIMENTS

Hereinafter, the present invention will be described in more detail with reference to the accompanying drawings. Terms and words used in the present specification and claims should not be interpreted as limited to ordinary or dictionary terms, but should be interpreted in a meaning understood by a person having ordinary skill in the art to which this invention belongs. In the following description and the accompanying drawings, descriptions of known functions and configurations that may unnecessarily obscure the subject matter of the present invention will be omitted. The accompanying drawings are provided by way of example so that those skilled in the art may fully understand the spirit of the present invention. Therefore, the present invention may be embodied in other forms not limited to the following drawings. In addition, like reference numerals designate like elements throughout the specification.

Embodiment 1

Referring to FIGS. 1 to 4, a first handle shaft 52 and a second handle shaft 53 are mounted on both sides of a driving body 50. A push button 55 for setting a lock state of the door lock is mounted at one end of the first handle shaft 52. A door lock main body 20 is mounted in front of the driving body 50. An indicator member 30 including a first display member 30*a* and a second display member 30*b* is mounted in front of the door lock main body 20. In addition, a main body cover 10 is mounted on the door lock main body 20, and a display portion 12 is formed on the main body cover 10.

The indicator member 30 is constructed in such a manner that the first display member 30*a* and the second display member 30*b* are linked to be pivoted in opposite directions to each other.

Here, the first display member 30*a* is constructed in a flat member having an approximately half arc shape, and the second display member 30*b* is also constructed in a corresponding shape to (or the same shape as) the first display member 30*a*.

A display portion 12 is formed on the front surface of the main body cover 10 to indicate a locked state of the door lock. Here, the display portion 12 is formed at the upper portion and/or the lower portion of the front surface of the main body cover 10 as shown in FIG. 3. The display portion 12 is formed by engraving letters for example, 'CLOSED' on the front surface of the main body cover 10 and hollowing them out.

In addition, a first mounting hole 21 and a second mounting hole 22 are formed in front of the door lock main body 20, and a first connection hole 35 of a second display member 30*b* is bolted to the first mounting hole 21 through a bolt B1, so that the second display member 30*b* is pivotably installed on the door lock main body 20. A second connection hole 33 of the first display member 30*a* and the second mounting hole 22 are connected to each other through the bolt B1, so that the first display member 30*a* is also pivotably installed on the door lock main body 20.

On the other hand, a connection end 31 is formed on the first display member 30*a*, and a support end 73 of a pin spring 70 is seated on the connection end 31. Here, the pin spring 70 may be constructed to have a shape as shown in FIG. 3 by bending a pin of a metallic material having elasticity and may be fixed to be mounted on the indicator member 30. Specifically, the pin spring 70 is formed by bending in an approximately circular shape a first connection area 71 and a second connection area 72 through which the bolt B1 passes. In addition, a support end 73 is formed to be bent from the second connection area 72 of the pin spring 70. Here, the support end 73 is seated on the connection end 31 of the first display member 30*a* of the indicator member 30. Therefore, the support end 73 of the pin spring 70 and the connection end 31 of the first display member 30*a* are elastically supported with each other.

On the other hand, the first connection hole 32 of the first display member 30*a* and the second connection hole 36 of the second display member 30*b* are connected to each other through the bolt B2, and the first display member 30*a* and the second display member 30*b* are linked to be pivoted in opposite directions to each other.

For example, when the first display member 30*a* is pivoted in the clockwise direction about second connection hole 33, the second display member 30*b* is pivoted in counterclockwise direction about the first connection hole 35.

Referring to FIGS. 4 to 6, a first handle shaft 52 and a second handle shaft 53 are connected to the driving main body 50, respectively. And referring to FIG. 5A, when a push button 55 is pressed, a push end 81 of the push button 55 in a first tube 52*a* moves a cam portion 91 in the axial direction inside the first tube 52*a*. At this time, a guide pin P2 is formed on the outer circumferential surface of the cam portion 91, and as shown in FIG. 4, the guide pin P2 is guided in the lengthwise direction of the second handle shaft 53 along a guide hole, thereby guiding the linear movement of the cam portion 91.

Referring to FIG. 5B and FIG. 5C, a pair of cam posts 91*c* and 91*d* extend and protrude in a predetermined length in front of the cam portion 91. The cam surfaces 91*c*' and 91*d*' are formed inside these cam posts 91*c* and 91*d*, respectively.

Also, a pin rotator 92 is inserted into the front portion of the cam posts 91*c*,91*d*. At this time, the pin rotator 92 has a pair of guide ribs 92*c* and 92*d* formed parallel to its longitudinal direction at the inner side thereof, and the guide ribs 92*c* and 92*d* slide in contact with the cam surfaces 91*c*' and 91*d*' of the cam posts 91*c* and 91*d*. Also, a pin coupling hole 92*h* penetrating in the vertical direction of the guide ribs 92*c* and 92*d* is formed on the pin rotator 92. And a driving pin P1 is installed in the pin coupling hole 92*h*.

Moreover, as shown in FIG. 5A, a spring S2 is installed between the cam portion 91 and the pin rotator 92.

When the push button 55 is pressed by this spring S2, the cam portion 91 is moved forward, and, at this time, the guide ribs 92*c* and 92*d* of the pin rotator 92 contact with the cam surfaces 91*c*' and 91*d*' of the cam posts 91*c* and 91*d*. When the cam portion 91 is gradually advanced in this state, the pair of guide ribs 92*c* and 92*d* of the pin rotator 92 are guided along the cam surfaces 91*c*' and 91*d*'. Consequently, as shown in FIG. 5C, the pin rotator 92 rotates counterclockwise.

On the contrary, when the pressing force on the push button 55 is released, the cam portion 91 is returned to its original state by the elastic force of the spring S2. That is, the cam portion 91 moves from the state of FIG. 5C to the state of FIG. 5B.

As such, when the cam portion 91 is moved forward by pressing the push button 55, the pin rotator 92 to which a driving pin P1 is connected as shown in FIG. 2 is rotated counterclockwise, so that the driving pin P1 pushes out the connection end 31 to pivot the first display member 30*a*. At this time, the second display member 30*b* also is pivoted to a certain radius in conjunction with the first display member 30*a*. Consequently, the first display member 30*a* and the second display member 30*b* of the indicator member 30 become in an open state to each other.

Meanwhile, in FIG. 5A, a guide hole 53*h* is formed in a second tube 53*a* so that the driving pin P1 of the pin rotator 92 moves by a certain radius, and the second tube 53*a* is connected to the front of a fixed member 50*b*. A key cylinder 95 is installed inside this second tube 53*a*. In addition, a handle locking body 96 is connected to the front of the second tube 53*a* and a handle portion 51 is provided in front of the handle locking body 96. At this time, the handle locking body 96 serves to lock the rotation of the handle portion 51 at the outside when the push button 55 is pressed. Also, a fixing block 99 having a cover part 97, a pushing post 98 and a spring S1 may be provided to release the handle lock state by using the fixing block 99. Since this is basically a configuration provided in the conventional lever-type door lock, detailed operation description is omitted.

In addition, a spring S2 is fitted between the cam portion 91 and the pin rotator 92 and inserted into a first tube 52*a*. Accordingly, the pin rotator 92 may be returned to its original state from a state in which the push button 55 is pressed by the elastic force of the spring S2.

According to the indicator-type door lock of the present invention constructed as described above, when the push button 55 is pressed in the room, the cam portion 91 is moved to rotate the pin rotator 92. At this time, the driving pin P1 of the pin rotator 92 moves along the guide hole 53*h* of the second tube 53*a*. And when the driving pin P1 pushes out the connection end 31 of the first display member 30*a*, the first display member 30*a* is pivoted clockwise from the position shown in FIG. 2. At this time, the second display member 30*b* also is pivoted to a certain radius in conjunction with the first display member 30*a*.

Accordingly, the first display member 30*a* and the second display member 30*b* are in an open state to each other and are placed at the corresponding position to the display portion 12. In this case, the first display member 30*a* and the second display member 30*b* may be colored with a predetermined color (for example, red). In a state in which the first display member 30*a* and the second display member 30*b* are opened to each other and placed at the corresponding position to the display portion 12 as described above, they are exposed to the outside through the display portion 12. Therefore, when the display portion 12 is seen with the naked eye from the outside, the red colored 'CLOSED' may be identified for the user to recognize that the door lock is now locked.

On the contrary, when the push button 55 returns to its original state (i.e. the push button returns to its original state) by operating the handle 51 in the room (i.e. the release operation by the handle locking body 96), the driving pin P1 is returned to its original state, and the external force (supporting force) to press the first display member 30*a* no longer exists. Accordingly, the first display member 30*a* and the second display member 30*b* are returned to their original state (closed state) by the elastic force of the pin spring 70 and deviate from the corresponding position to the display portion 12. Therefore, the red color disappears from the letters 'CLOSED' of the display portion 12 of the main body cover 10. In this way, it is possible for the outside user to recognize the unlocked state of the door lock.

Embodiment 2

Referring to FIG. 7, the present invention may further include a display plate 60 in front of the door lock main body 20 in addition to the indicator member 30 having the first display member 30*a* and the second display member 30*b*.

Specifically, the display plate 60 is provided as a green circular plate, and a first through hole 61 and a second through hole 62 are formed on the side of the display plate 60. In addition, letters marked with 'OPEN' are displayed on the upper and lower portions of the display plate 60, respectively. Also, letters 'CLOSED' are displayed on the first display member 30*a* and the second display member 30*b*, respectively. (Not seen in FIG. 7)

Meanwhile, display openings 11*b* and 12*b* are formed in a predetermined area in front of the main body cover 10. The first display member 30*a* and the second display member 30*b* are pivoted to a certain radius respectively by the driving pin P1 (FIG. 4) of the driving body 50 to be in an open state to each other.

Accordingly, in a state in which the first display member 30*a* and the second display member 30*b* are not opened, a portion of the display plate 60 is exposed to the outside through the display openings 11*b* and 12*b* as shown in FIGS. 8A and 8B, and the user may easily recognize it with the naked eye. That is, the letters 'OPEN' of the display plate 60 are exposed through the display openings 11*b* and 12*b* (see FIG. 8B).

On the other hand, when the locking state of the room is set by pressing the push button 55 of the driving body 50, the driving pin P1 of the driving member 50 is pivoted and the first display member 30*a* and the second display member 30*b* are opened to each other (see FIG. 2). In this case, these members 30*a* and 30*b* cover the letters 'OPEN' of the display plate 60 respectively and the letters 'CLOSED' on the first display member 30*a* and the second display member 30*b* are exposed to the outside through the display openings 11*b* and 12*b* (see FIG. 8A).

Embodiment 3

Referring to FIGS. 9A and 9B, the main body cover 10 of the present invention may further include an auxiliary display portion 12*b* marked with 'OPEN' in addition to a display portion 12*a* marked with 'CLOSED'. The auxiliary display portion 12*b* is formed by engraving letters 'OPEN' on the front surface of the main body cover 10 and hollowing them out.

In this case, when the first display member 30*a* and the second display member 30*b* are pivoted to be opened to each other, they are placed at the corresponding position to the display portion 12*a* marked with 'CLOSED' on the main body cover 10 (see FIG. 9B). However, in the usual state (unlocked state), they are placed at the corresponding position to the auxiliary display portion 12*b* marked with 'OPEN' (see FIG. 9A). Therefore, in this way, the user may more clearly recognize the locking/unlocking state of the door lock even with the naked eye from the outside.

Embodiment 4

Referring to FIG. 10A to FIG. 11B, according to the present embodiment, a first letter M1 marked with 'OPEN' is provided on the upper portion of the display plate 60, and a second letter M2 marked with 'CLOSED' is provided on the front surface of the first display member 30*a*. In addition, a display opening 11*a*' is formed on the upper portion of the body cover 10.

With this configuration, when the first display member 30*a* and the second display member 30*b* are opened to each other as shown in FIG. 11A, the second letter M2 is exposed through the display opening 11*a*' as shown in FIG. 11B. Conversely, when the first display member 30*a* and the second display member 30*b* are closed to each other as shown in FIG. 10A, the first letter M1 is exposed through the display opening 11*a*' as shown in FIG. 10B.

Embodiment 5

Referring to FIG. 12A to FIG. 13B, a second display member 30*b*' is provided with an indicator region 35*s*, and a display opening 13*a* is provided on the front surface of the body cover 10. At this time, the indicator region 35*s* is provided in the form of extending by a predetermined area from an end of the second display member 30*b*'.

By such a configuration, when a first display member 30*a*' and the second display member 30*b*' are opened to each other as shown in FIG. 13A, the indicator region 13*a* is exposed through the display opening 13*a* as shown in FIG. 13B. On the contrary, when the first display member 30*a*' and the second display member 30*b*' are closed to each other as shown in FIG. 12A, a portion of a display plate 60' is exposed through the display opening 13*a* as shown in FIG. 12B.

Accordingly, the user may easily recognize whether the door lock is locked or unlocked indoors with the naked eye from the outside.

Embodiment 6

Referring to FIG. 14, a single display member 30*c* is provided as the indicator member.

Specifically, the display plate 60 is mounted in front of the door lock body 20, and the single display member 30*c* is pivotably installed in front of the display plate 60. Also, as in the above-described embodiment, one display opening 13*a* is formed in the main body cover 10.

Herein, the first mounting hole 21 and the second mounting hole 22 are formed in the door lock main body 20. In addition, the first through hole 61 and the second through hole 62 are formed in the display plate 60 to correspond to the first mounting hole 21 and the second mounting hole 22, respectively. The indicator region 35*s* is formed at the front end of the single display member 30*c*, and a single connection hole 33*a* is formed at an end of the single display member 30*c*.

Meanwhile, the pin spring 70 is fixed to the door lock main body 20 through a plurality of bolts B1. That is, the bolts B1 are inserted into the first connection area 71 and the second connection area 72 of the pin spring 70, respectively. At this time, one bolt passes through the first through hole 61 of the display plate 60, and another bolt sequentially passes through the single connection hole 33*a* of the single display member 30*c* and the second through hole 62 of the display plate 60, so that they are fastened to the first mounting hole 21 and the second mounting hole 22 of the door lock main body 20, respectively.

Accordingly, the single display member 30*c* is pivotably installed about the single connection hole 30*a* by a certain angle. Also, the pin spring 70 is disposed such that the support end 73 elastically supports the connection end 31 of the single display member 30*c*. Therefore, even when the single display member 30*c* has been pivoted in one direction as shown in FIGS. 16A and 16B, it may be returned to the original state by the elastic force of the pin spring 70.

Referring to FIGS. 15A and 15B, in a usual state in which the single display member 30*c* is not pivoted, a part of the front surface of the display plate 60 is exposed through the display opening 13*a* of the main body cover 10 (see FIG. 15B).

Referring to FIGS. 16A and 16B, when the single display member 30*c* is pivoted clockwise from the state of FIGS. 15A and 15B, the indicator region 35*s* of the single display member 30*c* is exposed through the display opening 13*a* of the main body cover 10 (see FIG. 16B).

Thus, according to this embodiment, there is an advantage that the structure may be simplified by applying the single display member 30*c* as the indicator member.

While the present invention has been particularly shown and described with reference to the particular embodiments thereof, it is to be understood that the invention is not limited to the disclosed embodiments, but, on the contrary, It should be understood by those skilled in the art that various changes in form and details may be made therein without departing from the spirit and scope of the invention.

What is claimed is:

1. An indicator-type door lock comprising:

a handle shaft having a handle for unlocking and a push button for locking;

a driving body mounted with the handle shaft;

a door lock main body having a main body cover with at least one display portion displaying the locked state of the door lock to the outside, and installed in front of the driving body;

an indicator member installed within the door lock main body to be pivoted to a certain radius, and being exposed through the display portion; and a turning drive member for pivoting the indicator member located within the handle shaft and rotated inside the handle shaft when the push button is pressed to pivot the indicator member;

wherein the turning drive member comprises:

a cam portion moving in a straight direction in the handle shaft by the push button and having at least one cam post formed on its front surface; and a pin rotator having at least one guide rib guided along the cam post of the cam portion on an inner circumferential surface thereof and a driving pin mounted on an outer circumferential surface thereof to pivot the indicator member to one side; and wherein the indicator member comprises:

a first display member where one end is pivotably mounted on the door lock main body, and a second display member where one end is pivotably mounted on the door lock main body and is pivoted in a direction opposite to the first display member about a pivot point in conjunction with the first display member.

2. The indicator-type door lock according to claim 1, wherein the display portion is provided in a shape in which a portion of the main body cover is penetrated, the indicator member is exposed to the outside through penetrated area of the display portion.

3. The indicator-type door lock according to claim 2, wherein the door lock main body has a display plate marked with at least one display letter, and the indicator member is pivotally mounted in front of the display plate.

4. The indicator-type door lock according to claim 1, wherein a pin spring is installed in the pivot point of the first display member and the second display member to apply an elastic force between the first display member and the second display member.

5. The indicator-type door lock according to claim 1, any one of the first display member and the second display member further comprises an indicator region integrally extending from an end of the first display member or the second display member.

6. The indicator-type door lock according to claim 1, the indicator member comprises a single display member pivotably mounted on the door lock main body, and a pin spring fixed to the door lock main body to elastically support the single display member.

* * * * *